US005467540A

United States Patent [19]

Bastien

[11] Patent Number: 5,467,540

[45] Date of Patent: Nov. 21, 1995

[54] DIFFUSER FOR HAIR DRYER

[76] Inventor: Ernest J. Bastien, 362 DeAnza Dr., Vallejo, Calif. 94589

[21] Appl. No.: 272,798

[22] Filed: Jul. 11, 1994

[51] Int. Cl.[6] ..... A45D 20/00

[52] U.S. Cl. ..... 34/97; 392/385; 392/380; 34/283

[58] Field of Search ..... 34/96, 97, 98, 34/99, 100; 392/379, 380, 383–385; 239/101, 382, 389

[56] References Cited

U.S. PATENT DOCUMENTS

| | | | |
|---|---|---|---|
| 4,097,722 | 6/1978 | Soler et al. | 34/97 |
| 4,218,608 | 8/1980 | Maroney | 34/97 |
| 4,316,077 | 2/1982 | Carlson | 34/97 |
| 5,054,211 | 10/1991 | Shulman | 34/97 |
| 5,235,759 | 8/1993 | Rizzuto, Jr. | 34/97 |
| 5,303,483 | 4/1994 | Chan | 34/97 |

*Primary Examiner*—Denise L. Gromada
*Attorney, Agent, or Firm*—Harris Zimmerman

[57] ABSTRACT

A diffuser to diffuse the air blast of a hair dryer may be embodied as a removable accessory for existing hair dryers or an integral feature in a hair dryer. A tubular member includes a first end to receive the output of the hair dryer, and a diffuser plate is pivotally secured in the opposed, second end of the tubular member. The diffuser plate is rotatable from a fully open position in which the entire output of the dryer blower is delivered from the second end, to a fully closed position in which the second end is blocked by the diffuser plate. The diffuser plate includes a plurality of holes in a spaced array, permitting a fraction of the dryer output to be delivered from the second end of the tubular member at a reduced velocity. The tubular member includes a plurality of vent holes disposed upstream of the diffuser plate to exhaust a substantial portion of the air flow when the diffuser plate is closed to the attenuating position. The diffuser plate is mounted on a pivot shaft, in the fashion of a choke valve, and an actuating lever translates a link joined to a lug on the end of the pivot shaft. Alternatively, a gear is secured to the end of the pivot shaft, and an actuating slide engages the gear in rack and pinion fashion to rotates the shaft and diffusion plate from the fully open to fully closed position.

17 Claims, 4 Drawing Sheets

DIFFUSER FOR HAIR DRYER

BACKGROUND OF THE INVENTION

This invention relates to hair dryers, and more specifically to diffusers for attenuating the air flow from hair dryers.

A hair dryer generally comprises a blower for pushing an air stream past a heating element, and a tubular output duct for collimating and delivering the hot air stream in a preferred direction. For domestic and professional use, such dryers are generally conformed in a pistol-like configuration, since centuries of technological development have determined that a pistol is a preferred format for vectoring movement toward a target. Hair dryers are employed not only to remove moisture from hair, but also to aid in styling and shaping the hair as it dries to form an esthetically pleasing result. The heated air flow may exit the dryer at a temperature of a few hundred degrees Fahrenheit. This high temperature helps to remove moisture quickly from saturated hair. However, as the hair dries the hot air blast threatens to heat the hair to such an extent that it may be damaged. Such damage may be due to removal of volatile oils from the hair, or from protein degradation within the matrix of the hair shafts themselves. Thus it is necessary to attenuate the heating effect of the dryer as drying progresses. Many hair dryers provide blower motors having more than one speed setting, and may also include means for reducing the output of the heating elements. However, the air stream remains a highly directed blast of dry, high temperature air that may have too much velocity and heat for delicate finishing and styling.

In response to these factors, there have been developed in the prior art various forms of diffusers for attenuating the hot air blast from hair dryers. Some of these devices comprise baffling structures that are removably secured to the output end of the hair dryer tube. Such devices are inconvenient to store and install, and removal of the device after use may be hazardous, due to the possibility of sustaining burns from the heated surfaces. Other arrangements include umbrella-like arrangements Ibr blocking air flow, a system that is mechanically complicated and prone to mechanical failure. Likewise, some diffusers have employed rotating vanes to partially constrict the output orifice, but the resulting effect is to increase the velocity of the air stream. The prior art indicates a lack of a reliable device for selectively diffusing the air blast of a hair dryer.

SUMMARY OF THE PRESENT INVENTION

The present invention generally comprises a diffuser arrangement for a hair dryer that is designed to selectively diffuse the air blast of the dryer as required by the user or hair dresser. A salient feature of the invention is that it may be embodied as a separate accessory that can be removably joined to existing hair dryers, or it may comprise an original equipment feature integrally included in a hair dryer unit.

The separate accessory embodiment includes a tubular member having a first end dimensioned to receive the output tube of an existing hair dryer in a frictional engagement. A diffuser plate is pivotally secured in the opposed, second end of the tubular member, and means are provided for the dryer operator to rotate the diffuser plate from a fully open position in which the entire output of the dryer blower is delivered from the second end, to a fully closed position in which the second end is substantially completely blocked by the diffuser plate. The diffuser plate is provided with a plurality of holes extending therethrough in a matrix, permitting a small fraction of the dryer blower output to be delivered from the second end of the tubular member at a reduced velocity.

The tubular member is provided with a plurality of vent holes disposed adjacent to and upstream of the diffuser plate, the diffuser holes being spaced annularly about the circumference of the tubular member. With the diffuser plate in the fully open position, the air flow from the dryer blower exits from the second end of the tubular member, with little loss through the vent holes. When the diffuser plate is closed to the attenuating position, a substantial portion of the air flow is forced out of the vent holes, with a small portion of the air flow passing through the matrix of hole in the diffuser plate.

The diffuser plate is mounted on a pivot shaft, in the fashion of a choke valve. In one embodiment of the invention, an actuating lever is pivotally secured to the one end of the tubular member, and a link member extends from the lever to a lug on the end of the pivot shaft. The components are arranged so that a small angular excursion of the actuating lever causes the shaft to rotate through a 90° angle to rotate the diffusion plate from the fully open to fully closed position. A tension spring is connected from the link member to the tubular member to resiliently bias the system to fully open the diffuser plate. In another embodiment, a gear is secured to the end of the pivot shaft, and an actuating slide is secured to the tubular member. The slide includes teeth arranged in a linear array to engage the gear in rack and pinion fashion, so that linear translation of the slide rotates the shaft through a 90° angle to rotate the diffusion plate from the fully open to fully closed position.

Either of the embodiments described above may be provided on the tubular output duct of any typical hair dryer as an .original equipment feature.

DESCRIPTION OF THE PREFERRED EMBODIMENT

Figure 1:
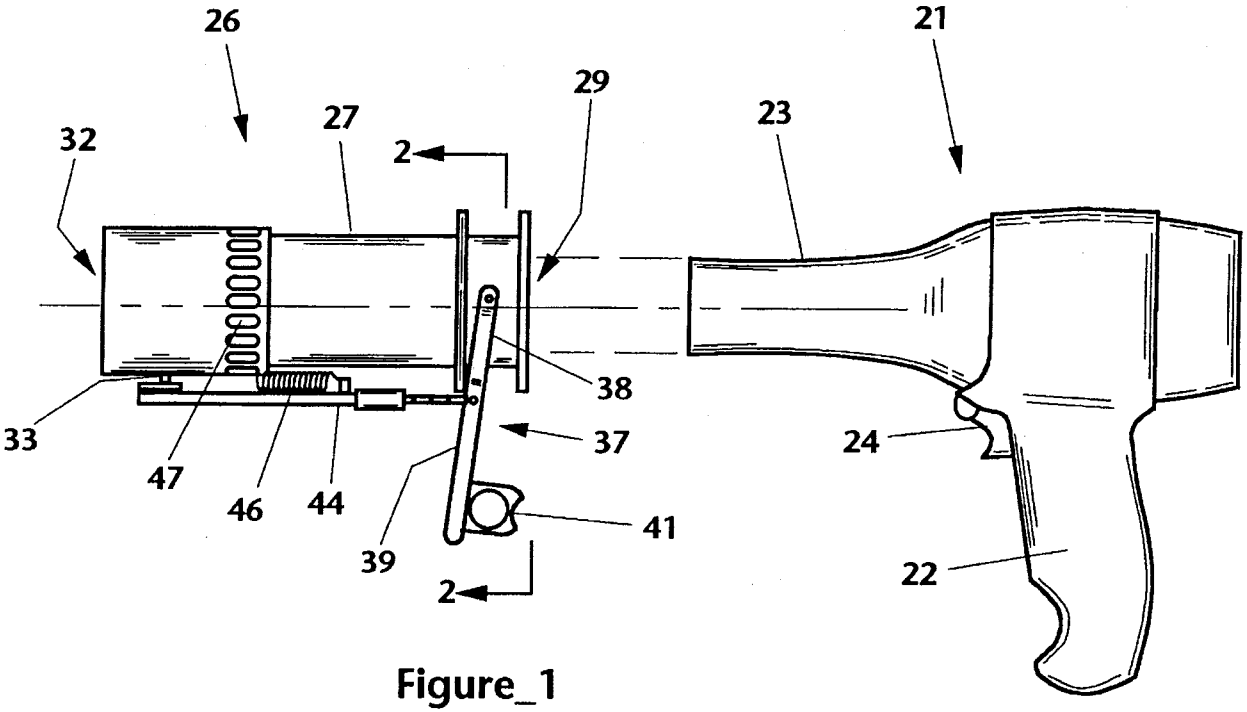
FIG. 1 is an exploded side view of one embodiment of the separate accessory embodiment of the invention.

The present invention generally comprises a diffuser arrangement for a hair dryer that is designed to selectively diffuse the air blast of the dryer as required by the user or hair dresser. With regard to FIG. 1, one embodiment of the invention comprises a separate diffuser accessory unit 26 that is adapted to be removably secured to a typical hand-held hair dryer 21. The dryer 21 generally includes a handle 22, a tubular output duct 23, and a control switch 24. Often hand-held dryers are configured in a pistol-like arrangement for convenience, and are depicted as such herein. However, any hair dryer having a tubular output duct 23 may be employed in conjunction with the embodiment 26.

Figure 2:
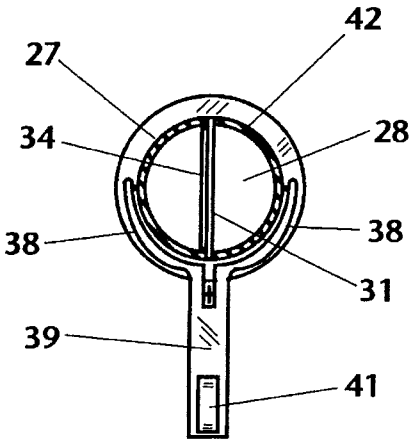
FIG. 2 is a cross-sectional end view of the invention, taken along line 2—2 of FIG. 1.
Figure 3:
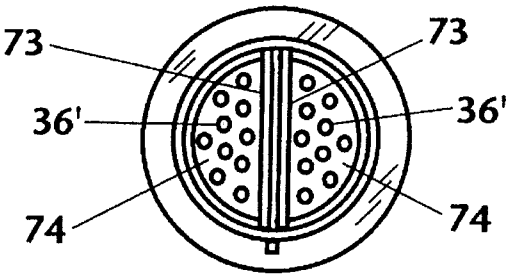
FIG. 3 is an end view of a further embodiment of the invention, in which a pair of diffuser plates are employed to attenuate the hair dryer air flow.
Figure 9:
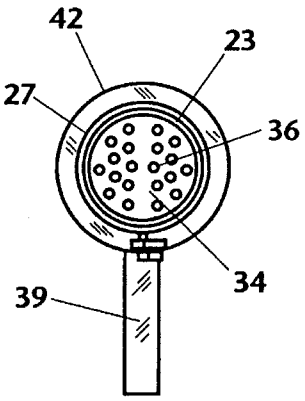
FIG. 9 is an end view of the invention as depicted in FIGS. 7 and 8, showing the diffuser plate in the fully closed configuration.
Figure 4:
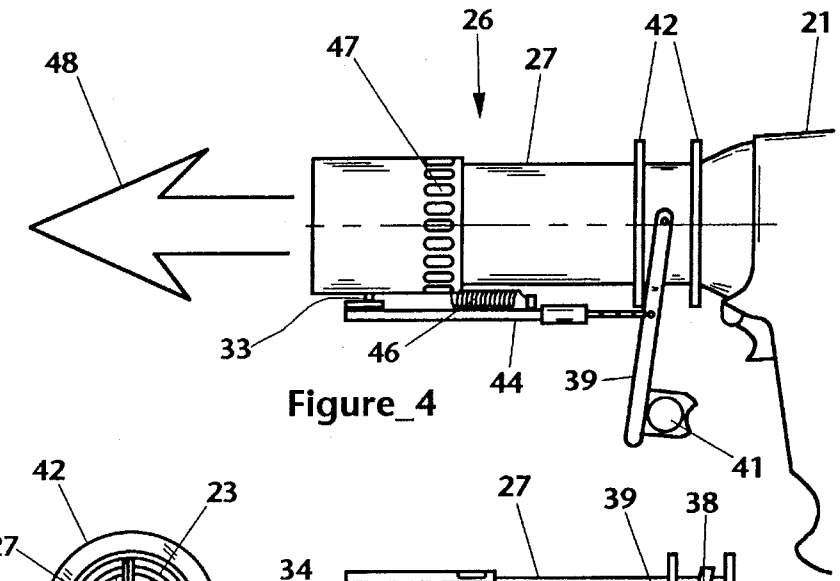
FIG. 4 is a side elevation of the embodiment of FIGS. 1–3, shown assembled to a hair dryer and disposed in the fully open configuration.
Figure 6:
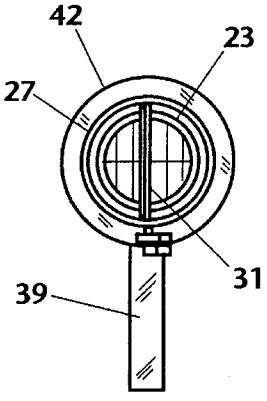
FIG. 6 is an end view of the invention as depicted in FIGS. 4 and 5, showing the diffuser plate in the fully open configuration.

With reference to FIGS. 1–3, the diffuser unit 26 includes a tubular body 27 having a bore 28 extending therethrough. At one end 29 of the tubular body, the bore 28 is dimensioned to receive the tubular output duct 23 of the hair dryer 21, so that the diffuser unit 26 is frictionally engaged with the hair dryer in removable fashion, as shown in FIG. 4. A pivot shaft 31 extends diametrically across the tubular body adjacent to the other end 32 thereof. One end 33 of the pivot shaft extends through the tubular body and protrudes exteriorly thereof. A circular diffuser plate 34 is secured to the pivot shaft, the pivot shaft extending diametrically with respect to the diffuser plate 34. The diameter of the diffuser plate is slightly smaller than the bore 28, so that the diffuser plate 34 may be rotated about the axis of the shaft 31 from an open position parallel to the axis of the bore 28 (FIGS. 2 and 6) to a closed position perpendicular to and blocking the bore 28 (FIG. 9). The diffuser plate is provided with a plurality of small holes 36 spaced apart and adapted to pass a small amount of the air stream from the hair dryer 21 when the diffuser plate is in the close disposition.

The diffuser 26 further includes an actuating lever assembly 37 to selectively activate the diffuser plate. The assembly 37 comprises a yoke-like clevis 38 pivotally secured to the tubular body 27 adjacent to the end 29, and a stem 39 integrally joined to the clevis 38. A finger loop 41 extends from the distal end of the stem 39. A pair of annular flanges 42 extend diametrically from the tubular body 27 in closely spaced relationship adjacent to the end 29 to serve as stops to limit the rotation of the lever assembly 37. The flanges also serve as convenient handles for grasping the diffuser 26 in installing or removing the diffuser with respect to the duct 23.

Figure 5:
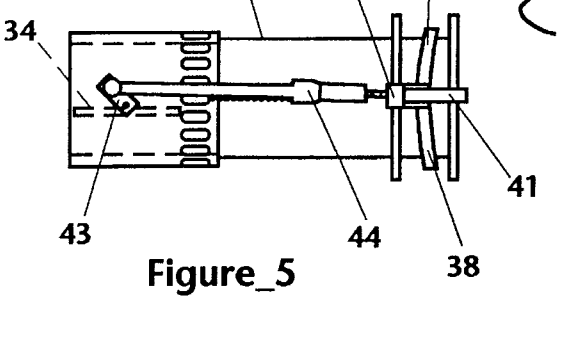
FIG. 5 is a bottom view of the invention as depicted in FIG. 4, showing the actuating lever and linkage in the fully open configuration.

Joined to the end 33 of the shaft 31 is a lug 43, which includes an outer end spaced apart from the shaft 31. An arm or link 44 is pivotally joined to the outer end of the lug 43, and extends to join the proximal end of the lever stem 39. A spring 46 is coupled between the link 44 and the tubular body to resiliently bias the link to the disposition shown in FIGS. 4–6, in which the diffuser plate 34 is held in the open position.

A salient feature of the diffuser assembly 26 is the provision of a plurality of vent holes 47 formed in the tubular body 27 adjacent to the diffuser plate and upstream thereof. The holes 47 are spaced annularly about the circumference of the tubular body, and are provided to exhaust any back pressure when the diffuser plate is closed. With the diffuser assembly 26 joined to a hair dryer 21, the air stream from the dryer passes through the bore of the diffuser assembly virtually unimpeded. The spring 44 biases the diffuser plate 34 to the open position, shown in FIGS. 5 and 6, and the air stream within the bore of the diffuser bypasses the vent holes 47 to form a directed air blast 48 for drying hair.

Figure 7:
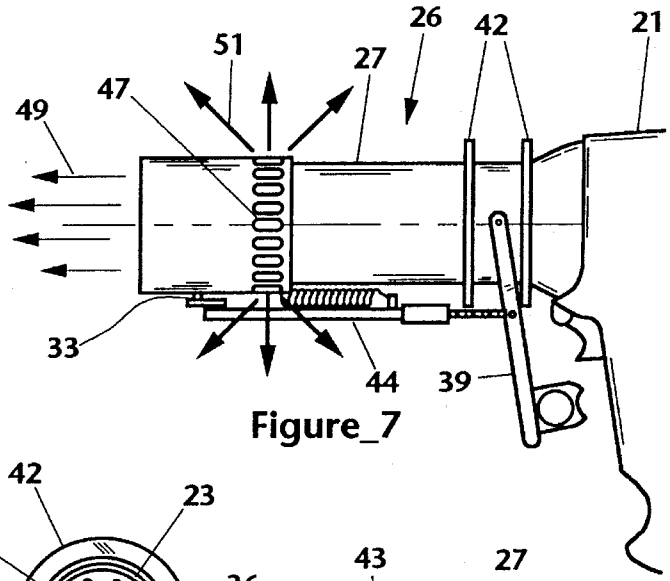
FIG. 7 is a side elevation of the embodiment of FIGS. 1–3, shown assembled to a hair dryer and disposed in the fully diffused configuration.
Figure 8:
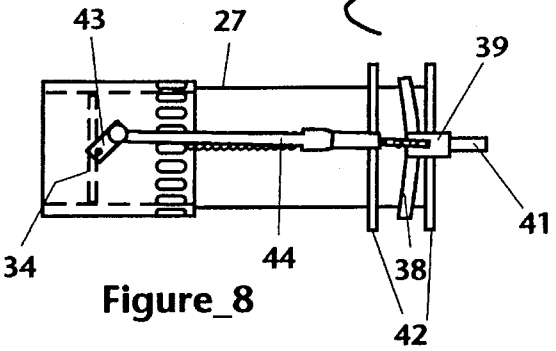
FIG. 8 is a bottom view of the invention as depicted in FIG. 7, showing the actuating lever and linkage in the fully diffused configuration.

To attenuate the air blast from the dryer, the operator digitally engages the loop 41 and pulls it toward the handle of the dryer until the lever stem impinges on the rear ting 42, as shown in FIG. 7. The lever 39 translates the linking arm 44 rearwardly against the elastic force of spring 46, rotating the lug 43 and the shaft 31 to pivot the diffuser plate 34 to the closed position, as shown in FIGS. 8 and 9. The matrix of holes 36 in the diffuser plate permits a soft flow of low velocity air 49 to be emitted from the distal end of the tubular body 27, while the great proportion of the hair dryer air flow is diverted by the diffuser plate to be exhausted through the vent holes 47. Thus the air flow 49 is available and directable for completion of hair drying and styling. The vent holes 47 prevent overheating of the dryer motor and heating elements.

Figure 13:
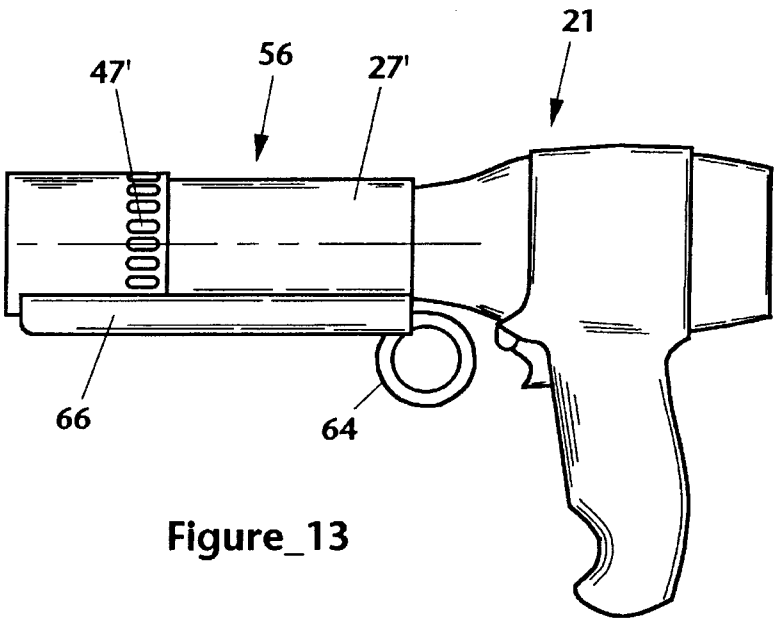
FIG. 13 is a side elevation showing the embodiment of FIGS. 10–12 assembled to a typical hair dryer.
Figure 10:
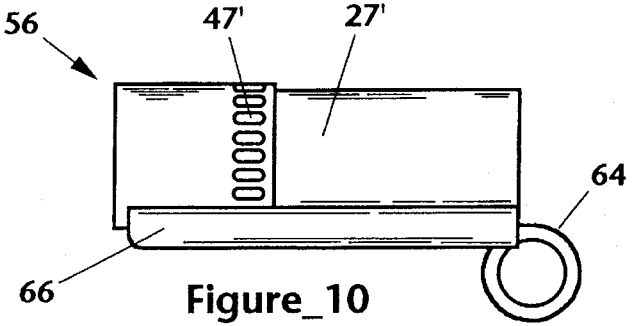
FIG. 10 is a side elevation of a further embodiment of the separate accessory form of the invention.

In a further embodiment of the invention, shown in FIGS. 10–13, components common to the previous embodiment are labeled with the same reference numerals provided with a prime (') designation. The diffuser unit 56 includes a tubular body 27 having a bore 28 extending therethrough. As before, one end 29' of the bore 28' is dimensioned to receive the tubular output duct 23 of a hair dryer 21, so that the diffuser unit 56 is frictionally engaged with the hair dryer in removable fashion (FIG. 13). A pivot shaft 31' extends diametrically across the bore 28' and is journaled in the tubular body 27'. The diffuser plate 34' is secured to the pivot shaft, the shaft extending diametrically across the plate. The vent holes 47' are disposed adjacent to the position of the diffuser plate 34'.

Figure 11:
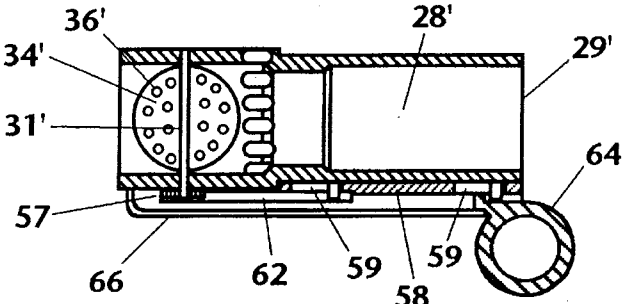
FIG. 11 is a cross-sectional side elevation of the embodiment depicted in FIG. 10.
Figure 12:
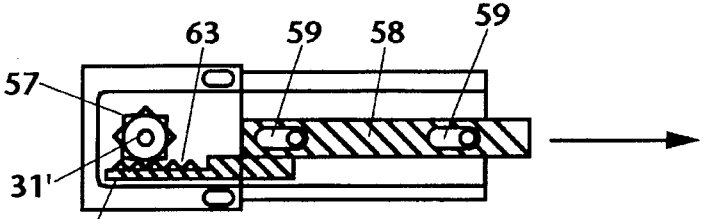
FIG. 12 is a partially sectioned bottom view of the embodiment depicted in FIGS. 10 and 11.

Joined to one end of the shaft 31' is a gear 57. A slide arm 58 is disposed parallel to the longitudinal axis of the bore 28', and is secured to the exterior of the tubular body 27' by means of a pair of pins 61 extending through longitudinally extending slots 59 formed in the arm 58. The slots 59 provide limited freedom of longitudinal translation for the arm 58. A spur 62 extends from the arm 58, and includes a plurality of teeth 63 arranged in linear array. The teeth 63 are disposed to engage the gear 57 in rack and pinion fashion, so that longitudinal translation of the arm 58 causes rotation of the gear 57 and the shaft 31'. A spring (not shown for purposes of drawing clarity) is secured between the arm 58 and the tubular body 27' to bias the arm 58 toward a position in which the diffuser plate 34' is held in the fully open position, as shown in FIG. 11. The diffuser plate 34' is provided with a matrix of small holes 36' to emit a diffuse, low velocity air stream when the diffuser plate 34' is closed.

A finger loop 64 is provided at the proximal end of the slide arm 58 to facilitate digital actuation of the slide arm to rotate the diffuser plate 34' to achieve the effects described with regard to the previous embodiment. A housing 66 is secured to the exterior of the tubular body 27 and disposed about the assembly of the gear 57 and slide arm 58 to protect the mechanism from dirt and damage.

To attenuate the air blast from the dryer, the operator digitally engages the loop 64 and pulls it toward the handle of the dryer until the slide arm reaches the limit imposed by the slots 59 and pins 61. The slide arm 58 translates the spur 62 rearwardly against the elastic force of the spring, causing the teeth 63 to rotate the: gear 57 and the shaft 31' to pivot the diffuser plate 34' to the closed position. The matrix of holes 36' in the diffuser plate permits a soft flow of low velocity air to be emitted from the distal end of the tubular body 27', while the great proportion of the hair dryer air flow is diverted by the diffuser plate to be exhausted through the vent holes 47'.

Figure 14:
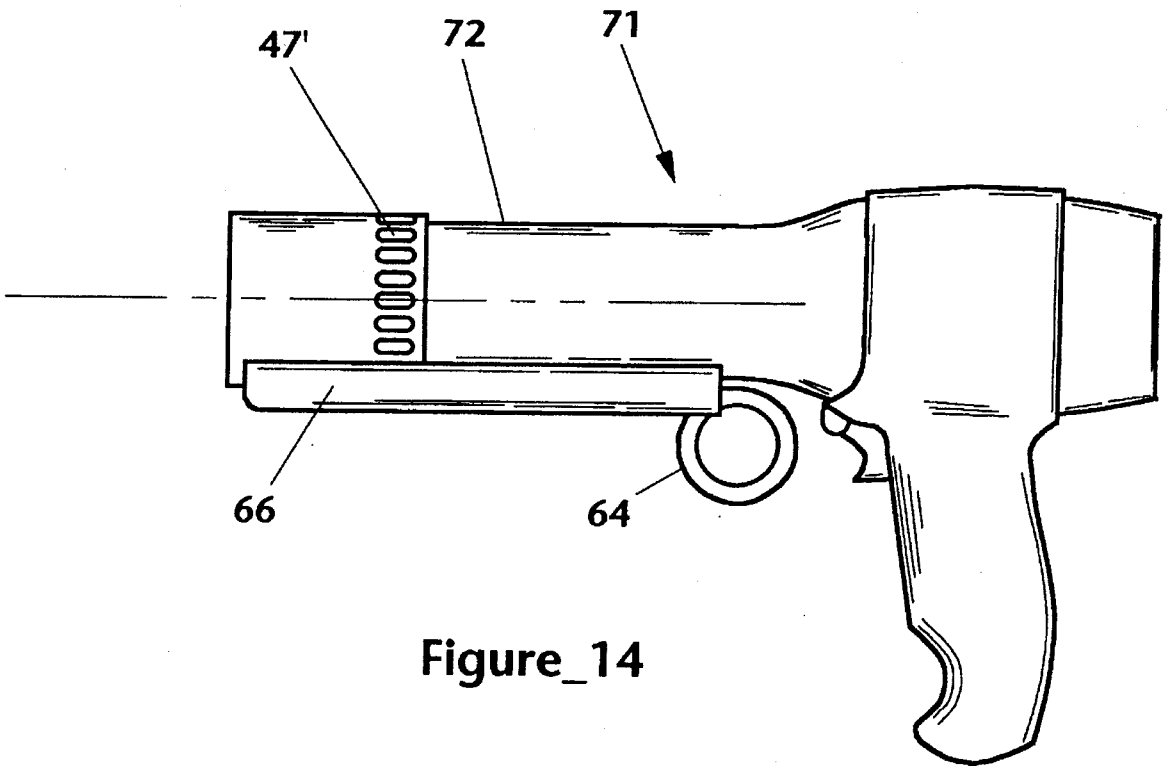
FIG. 14 is a side elevation of a further embodiment of the invention, in which a diffuser plate assembly is incorporated integrally in a hair dryer unit.

In a further embodiment of the invention, depicted in FIG. 14, a hair dryer unit 71 is provided with the diffuser plate mechanism described previously with reference to FIGS. 10–13. This embodiment includes the slide arm 58, spur 63 and gear 57 disposed within the housing 66, all of these components joined directly to the tubular output duct 72 of the dryer 71. Likewise, the diffuser plate 4' and shaft 31' are disposed with the distal end of the duct 72 to provide the air stream diffusing effect described previously. In may be noted that the embodiment described with reference to FIGS. 1, 2, and 4–9 may also be incorporated in a hair dryer unit as a built-in feature.

With regard to FIG. 3, a further embodiment of the invention discloses a feature that may be incorporated in any of the other embodiments described herein. A pair of pivot shafts 73 extend diametrically across the bore 28' of the device, and a pair of semicircular diffuser plates 74 are each secured to one of the pivot shafts 73. As before, the diffuser plates 74 are provided with a matrix of small holes to emit a soft stream of low velocity air when the diffuser plates are closed. Either of the mechanisms disclosed previously may be used to rotate the pair of diffuser plates in opposed directions between fully open and fully closed positions.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. A diffuser device for a hair dryer, including;

a tubular body member having a bore therethrough, said bore having an input end for receiving air flow from a blower and an output end for directing the air flow from the hair dryer;

a diffuser plate, and means for securing said diffuser plate in said bore in rotatable fashion;

means for pivoting said diffuser plate through a continuously variable angle from an open position in which said bore is substantially unobstructed to a closed position in which said bore is completely obstructed;

means for venting the air flow from the dryer when said diffuser plate is disposed in said closed position, including a plurality of vent holes extending through said tubular body member to said bore, said vent holes disposed in an annular array positioned adjacent to said diffuser plate in said closed position and between said diffuser plate and said input end; and, means for emitting an attenuated flow of air from said output end when said diffuser plate is disposed in said closed position, including a plurality of small holes extending through said diffuser plate and arrayed in spaced apart fashion.

2. The diffuser device of claim 1, wherein said means for securing said diffuser includes a pivot shaft extending across said bore.

3. The diffuser device of claim 2, wherein said means for pivoting said diffuser plate includes an arm extending longitudinally and generally parallel to the axis of said bore.

4. The diffuser device of claim 3, further including a lug extending eccentrically from said pivot shaft, and means for pivotally joining one end of arm to said lug.

5. The diffuser device of claim 4, further including an actuating lever assembly for translating said arm reciprocally in a longitudinal direction.

6. The diffuser device of claim 5, wherein said actuating lever assembly includes a lever having a first end pivotally secured to said tubular body member, a second, free end, and means for securing the other end of said arm to said lever..

7. The diffuser device of claim 6, wherein said first end of said lever includes a clevis spanning a portion of said tubular body member, and means for pinning said clevis to said tubular body member in pivotal fashion.

8. The diffuser device of claim 7, wherein said lever includes a second end opposed to said first end, and further including a finger loop extending from said second end of said lever.

9. The diffuser device of claim 1, wherein said input end of said bore is dimensioned to engage an output duct from a hair dryer in releasable frictional engagement.

10. The diffuser device of claim 1, wherein said tubular body member is coextensive with the output duct of a hair dryer.

11. A diffuser device for attenuating the air flow of a hair dryer, including;

a tubular body member having a bore therethrough, said bore having an input end for receiving air flow from the hair dryer and an output end for directing the air flow from the hair dryer;

a diffuser plate, and means for securing said diffuser plate in said bore in rotatable fashion;

means for pivoting said diffuser plate from an open position in which said bore is substantially unobstructed to a closed position in which said bore is substantially obstructed;

means for venting the air flow from the dryer when said diffuser plate is disposed in said closed position, including a plurality of vent holes extending through said tubular body member to said bore, said vent holes disposed adjacent to said diffuser plate and between said diffuser plate and said input end;

means for emitting an attenuated flow of air from said output end when said diffuser plate is disposed in said closed position, including a plurality of small holes extending through said diffuser plate and arrayed in spaced apart fashion;

said means for securing said diffuser including a pivot shaft extending across said bore and a gear secured to said pivot shaft;

said means for pivoting said diffuser plate including an arm extending longitudinally and generally parallel to the axis of said bore and a plurality of teeth carried on said arm and disposed to engage said gear in rack and pinion fashion; and, spring means for resiliently biasing said diffuser plate to said open position.

12. The diffuser device of claim 11, wherein said teeth are formed on a spur extending from said arm toward said gear.

13. The diffuser device of claim 12, further including at least one longitudinal slot formed in said arm, and at least one pin extending from said tubular body member through said slot to provide limited longitudinal translational movement for said arm.

14. The diffuser device of claim 13, further including means for permitting manual translation of said arm, including a finger loop secured to one end of said arm.

15. The diffuser device of claim 13, further including a housing enclosing said arm and said gear, said housing secured to an exterior portion of said tubular body member.

16. A diffuser device for attenuating the air flow of a hair dryer, including;

a tubular body member having a bore therethrough, said bore having an input end for receiving air flow from the hair dryer and an output end for directing the air flow from the hair dryer;

a plurality of diffuser plates, and means for securing said diffuser plates in said bore in rotatable fashion;

means for pivoting said diffuser plates through a continuously variable angle from an open position in which said bore is substantially unobstructed to a closed position in which said bore is completely obstructed;

means for venting the air flow from the dryer when said diffuser plates are disposed in said closed position, including a plurality of vent holes extending through said tubular body member to said bore, said vent holes disposed in an annular array positioned adjacent to said diffuser plates in said closed position and between said diffuser plates and said input end; and, means for emitting an attenuated flow of air from said output end when said diffuser plate is disposed in said closed position, including a plurality of small holes extending through said diffuser plates and arrayed in spaced apart fashion.

17. The diffuser device of claim 16, wherein said means for securing said diffusers plates in said bore includes a plurality of pivot shafts, each extending across said bore and supporting one of said plurality of diffuser plates.

* * * * *